US005913959A

United States Patent [19]

Klein et al.

[11] Patent Number: 5,913,959

[45] Date of Patent: Jun. 22, 1999

[54] ROTABLY DRIVEN BRAIDING MACHINE WITH THIRD YARNS CARRIED AND DELIVERED BY STATIONARY CARRIAGES ABOUT A BRAIDING POINT

[75] Inventors: John T. Klein, Mobile; Roy M. Broughton, Jr.; David G. Beale, both of Auburn, all of Ala.

[73] Assignee: Auburn University, Auburn University, Ala.

[21] Appl. No.: 09/008,455

[22] Filed: Jan. 16, 1998

[51] Int. Cl.[6] ..... D04C 3/48; D04C 3/40

[52] U.S. Cl. ..... 87/44; 87/45; 87/33

[58] Field of Search ..... 87/33, 37, 44, 87/45, 46, 47, 48, 54; 66/9 A

[56] References Cited

U.S. PATENT DOCUMENTS

| | | | |
|---|---|---|---|
| 887,259 | 5/1908 | Lundgren . | |
| 896,320 | 8/1908 | Rahm . | |
| 958,512 | 5/1910 | Blanc | 87/44 |
| 1,081,474 | 12/1913 | Wardwell . | |
| 1,305,490 | 6/1919 | Petersen | 87/44 |
| 1,512,605 | 10/1924 | Klein . | |
| 1,583,543 | 5/1926 | Frederickson | 139/13 |
| 1,602,442 | 10/1926 | Miller . | |
| 1,610,054 | 12/1926 | Hopkinson . | |
| 1,615,587 | 1/1927 | Klein et al. . | |
| 1,636,660 | 7/1927 | Hopkins | 87/44 |
| 1,748,553 | 2/1930 | Hopkinson | 87/44 |
| 1,949,854 | 3/1934 | Autem | 87/47 |
| 2,223,954 | 12/1940 | Ford | 96/3 |
| 2,232,524 | 2/1941 | Hackbarth | 96/3 |
| 2,464,899 | 3/1949 | Sokol | 87/48 |
| 2,696,836 | 12/1954 | Caldes | 139/13 |
| 3,007,497 | 11/1961 | Shobert | 138/125 |
| 3,543,280 | 11/1970 | Greczin | 66/9 A |
| 3,760,606 | 9/1973 | Greczin | 66/9 A |
| 3,871,194 | 3/1975 | Greczin et al. | 66/9 A |
| 4,372,191 | 2/1983 | Iannucci et al. | 87/48 |
| 4,380,949 | 4/1983 | Betta | 87/48 |
| 4,729,278 | 3/1988 | Graeff et al. | 87/48 |
| 5,099,744 | 3/1992 | Hurst et al. | 87/45 |
| 5,309,738 | 5/1994 | Morris | 66/9 A |
| 5,617,743 | 4/1997 | Rednour | 66/9 A |
| 5,700,533 | 12/1997 | You | 87/8 |
| 5,727,438 | 3/1998 | Beale et al. | 87/45 |
| 5,749,280 | 5/1998 | Scherzinger | 87/48 |
| 5,775,195 | 7/1998 | Haehnel et al. | 87/44 |
| 5,787,784 | 8/1998 | Scherzinger | 87/44 |

FOREIGN PATENT DOCUMENTS

| | | | |
|---|---|---|---|
| 607742 | 7/1926 | France | 87/44 |
| 607744 | 7/1926 | France | 87/44 |
| 94840 | 10/1920 | Sweden | 87/47 |

*Primary Examiner*—John J. Calvert
*Assistant Examiner*—Tejash D. Patel
*Attorney, Agent, or Firm*—Henry S. Jaudon; Cort Flint

[57] ABSTRACT

A braiding machine which operates to deliver a first set of yarns about a vertical axis along a first plane to a braiding point and a second set of yarns about the vertical axis along a second plane located above the first plane to the braiding point and a third set of yarns stationarily arranged about the vertical axis for delivery along a third plane intermediate of the first and second planes to the braiding point. The machine includes an interlacing mechanism which is associated with each yarn of the third set of yarns and including a rotating interlacing member. The interlacing member of each interlacing mechanism is operative to successively engage and carry the first yarns out of the first plane above said third plane over a third yarn of the third yarns and to carry the second yarns out of the second plane below the third plane beneath a third yarn of the third yarns causing each of the first and second yarns to successively interlace with each of the third yarns during their movement about the vertical axis. This positioning action between the first, second, and third yarns forming a braided fabric of superior strength and stability.

23 Claims, 11 Drawing Sheets

ROTABLY DRIVEN BRAIDING MACHINE WITH THIRD YARNS CARRIED AND DELIVERED BY STATIONARY CARRIAGES ABOUT A BRAIDING POINT

BACKGROUND OF THE INVENTION

The instant invention is directed to a braiding machine which operates with fewer than normal moving parts at higher than normal speeds to produce a braided fabric having particular structural characteristics which provide for a more stable, more diverse and a more sturdy braided fabric.

Braiding machines have long been known. Normally such machines operate with an extremely high number of moving parts formed to a close manufacturing tolerance to control each of the yarns to form a braided fabric. An example of such type of braiding machine is shown in U.S. Pat. No. 896,320.

Another known type device utilizes numerous cam tracks and cam controlled guides to move the yarns about each other to form the braided product. An example of this type of machine is shown in U.S. Pat. No. 1,615,587. Numerous variations of these arrangements exist and all possess similar drawbacks.

It is an object of the instant invention to provide a braiding machine without the above disadvantages.

Another object of the invention is a braiding machine capable of increased operating speed.

Another object of the invention is a braiding machine which operates with a limited number of close manufacturing tolerance moving parts to bring about interlacing of the yarns during braiding.

Another object of the invention is a braiding machine having a stationary carriage carrying an interlacing device and first yarns which are stationary relative to the other yarns which are moving.

Another object of the invention is an interlacing device which is operative to position yarns moving in opposite directions in a braided fabric about a stationary yarn.

SUMMARY OF THE INVENTION

The instant invention is directed to a braiding machine which includes a stationary frame supporting a central vertical shaft and having a braiding point. The machine has a first plate carrying first yarns mounted with the shaft and rotably driven in a first direction and a second plate carrying second yarns also mounted with the shaft and rotably driven in a second direction. First guides are arranged along a first plane and are carried by the first plate. These first guides each receive a yarn of the first yarns for delivery along the first plane during its passage to the braiding point. Second guides are arranged along a second plane and are carried by the second plate. The second guides each receive a yarn of the second yarns for delivery along the second plane during passage to the braiding point. Stationary carriages, also supported by the frame but at stationary points about the vertical shaft, carry and deliver third yarns along a third plane to the braiding point. The third plane is intermediate the first and second planes.

An interlacing wheel is carried by each of the stationary carriages and is arranged along the third plane to extend into positions to engage with the first and second yarns as they rotate along the first and second planes. The interlacing wheel successively engages and positions the first and second yarns over and under the stationary yarns as they extend along the stationary points to form a braided fabric.

A plurality of radially extending arms which are carried by a stationary third plate support a plurality of mounts which are adapted to support the stationary carriages. Each mount comprises a pair of freely rotating support wheels. The wheels are positioned so that a portion of their peripheries lie along the second plane. Associated with each mount is a drive wheel, which wheels are arranged about the frame in substantial vertical alignment with each of the pairs of support wheels.

The interlacing wheels include a disk having a support race for engaging individual of the support and driving wheels. A pair of gear plates are secured with the opposing faces of the disk with the teeth of the gear plates aligned and extending radially beyond the support race. In this position, the inner faces of the teeth engage with the outer faces of the support and driving wheels along the race and provide additional support for the carriage.

Each carriage includes a spool or bobbin mount for mounting a bobbin carrying the stationary yarn. The bobbin mount positions the bobbin along the third plane.

Each of the first and second plates carry a plurality of bobbins each with a yarn of the first and second yarns. A plurality of bobbin supports, also carried by the first and second plates, rotatably mount the support bobbins. A yarn feed control system, which determines the rate and the tension of delivery of the yarns from the bobbins to the braiding point, is associated with each bobbin support. Each yarn feed control system includes a pawl and ratchet arrangement for controlling the rate and duration of rotation of each bobbin.

A plurality of yarn guides are associated with each yarn control system. Included is a pair of movable yarn guides biased in opposed directions and located between a pair of stationary yarn guides. Movement of the yarn between the stationary guides and about the movable guides urges the movable yarn guides toward or away from each other in response to the tension on the yarn. A pawl and ratchet mechanism is associated with the movable yarn guides. These mechanisms control the rate of rotation of the bobbins which in turn controls the rate of yarn delivery in accordance with the yarn tension.

A braiding machine which operates to deliver a first set of yarns moving about a vertical axis in a first direction along a first plane to a braiding point and a second set of yarns moving about the vertical axis in a second direction along a second plane located above the first plane to the braiding point, and a third set of yarns, carried by carriage members in stationary positions about the vertical axis for delivery along a third plane intermediate of the first and second planes, to the braiding point.

An interlacing mechanism associated with each yarn of the third set of yarns and including a rotating interlacing member arranged along the third plane to extend into the first and second planes. The rotating member is operative to successively engage and carry the first yarns moving in the first direction out of the first plane, above the third plane and above a third yarn of the third yarns and also to engage and move second yarns moving in the second direction out of the second plane, below the third plane and below a third yarn of the third yarns, causing each of the first and second yarns to successively interlace with each of the third yarns during movement about the vertical axis to form a braided fabric at said braiding point.

Each interlacing member includes a disk having a circumferential outer surface of selected width forming a support race. Arranged at opposed faces of the disk are a pair of gear plates having aligned teeth which extend radially beyond the race. A mounting port is formed through the axis of the disk and the gear plates for rotably receiving a bobbin mounting stem. The stem extends from the disk inwardly. A counterbalance is secured with the outer end of the stem remote the vertical axis for retaining the stem against rotation with the rotating disk. A counterbalance, which comprises a half/moon weight, is secured with the stem.

A bobbin carrying a yarn of the third yarns is mounted for rotation about the stem. A yarn guide carried by the carriage guides the yarn from bobbin along the third plane during its passage to the braiding point. A tensioning member is carried by the stem and is operative to control the tension on the yarn during its passage from the bobbin to the braiding point.

The invention includes the method of braiding which comprises:

providing a first yarn supply and moving yarn of the first yarn supply about a central axis in a first direction along a first plane to a braiding point;

providing a second yarn supply and moving yarn of the second yarn supply about the central axis in a second direction along a second plane above the first plane to the braiding point;

providing a third yarn supply and delivering yarn of the third yarn supply along a plurality of substantially stationary axis arranged about the central axis and along a third plane intermediate the first and second planes to the braiding point; and, causing the first yarns as they pass the third yarns to deflect from the first plane to pass above the third plane and pass over each yarn of the third yarns and causing the second yarns as they pass the third yarns to deflect downward from the third plane to pass beneath each yarn of the third yarns thereby forming a braided fabric.

The first and second yarns pass each other in their respective planes at an intermediate circumference position between interlacing mechanisms. Only one yarn of the first and second set can engage the interlacing mechanism at a given time.

DESCRIPTION OF A PREFERRED EMBODIMENT

Figure 1:
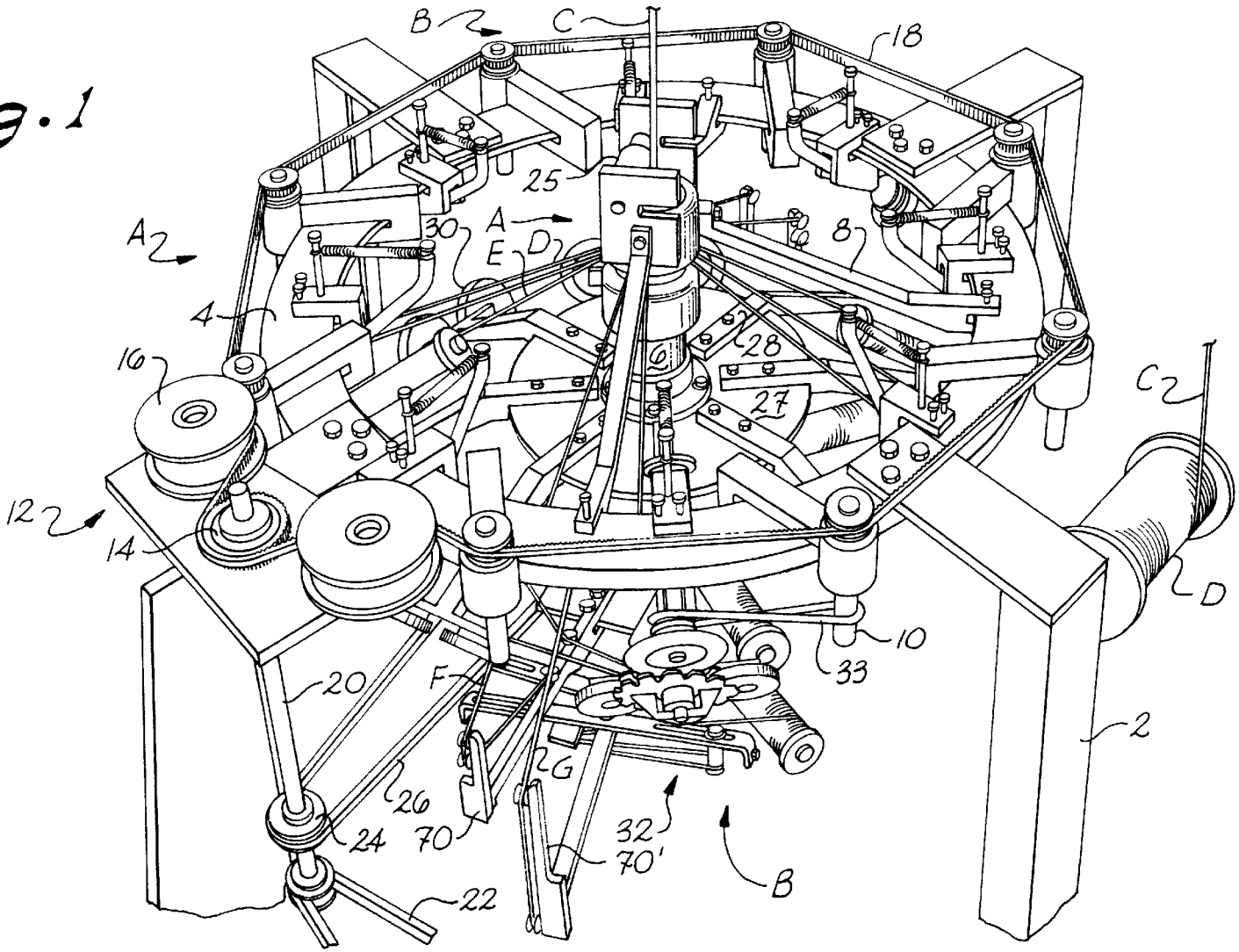
FIG. 1 is a perspective view of the braiding machine of the invention.
Figure 2:
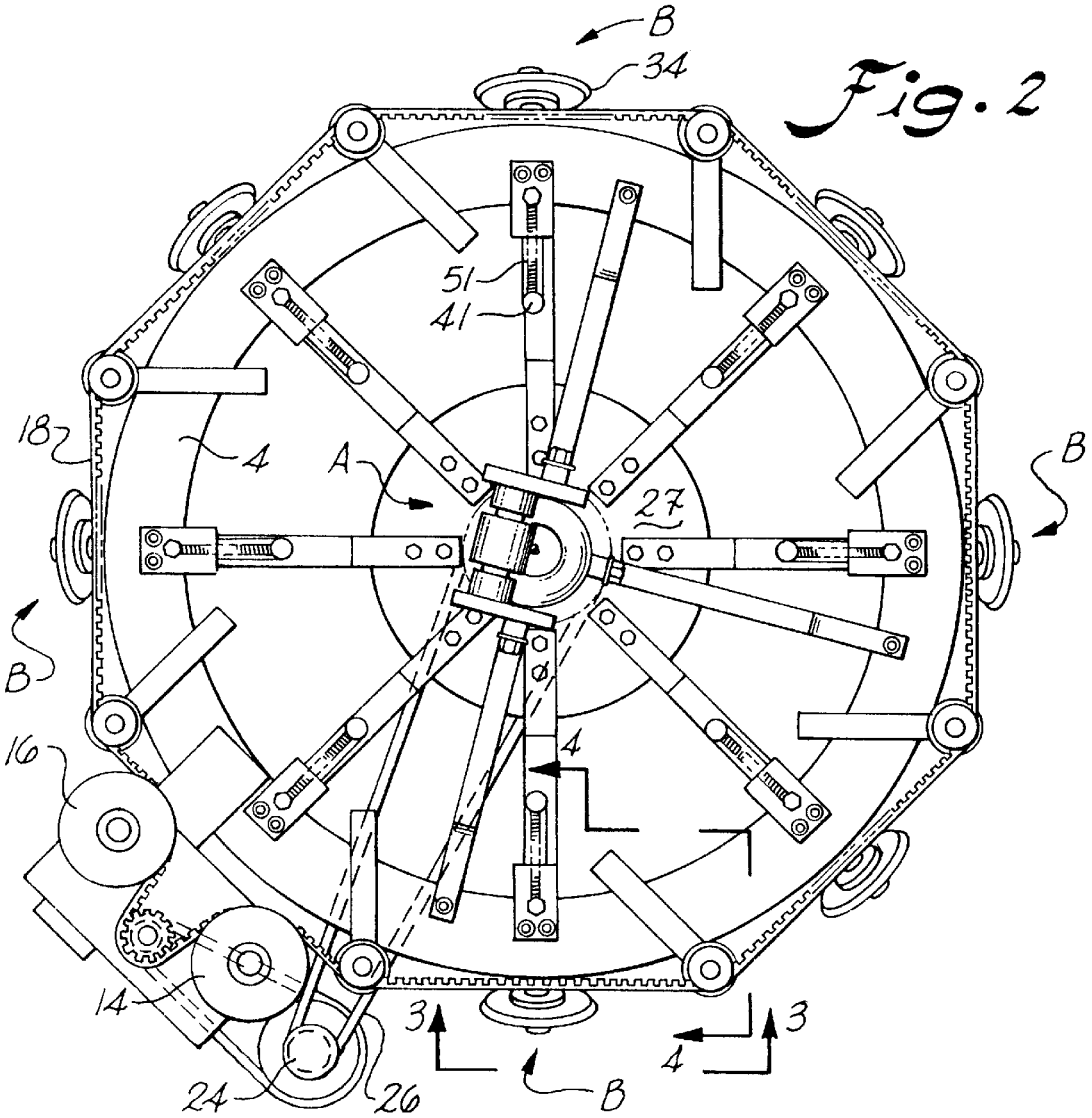
FIG. 2 is a top view of the device according to FIG. 1.

Turning now to the drawings, FIGS. 1 and 2 show generally the structure of a braiding machine incorporating the features of the instant invention. A frame 2 which includes a plurality of vertical pillows supports an upper ring 4 and a centrally mounted vertical stationary shaft 6. A braiding head 7 is located above shaft 6 and is supported by a plurality of braces 8 mounted about the inner periphery of ring 4. Mounted about the outer periphery of ring 4 are a plurality of bearings each carrying a spindle 10 carrying a pulley at its upper end. A drive arrangement 12 is secured to the periphery of ring 4 and includes a drive gear 14 and two idler pulleys 16. A drive belt 18 is engaged with the idler pulleys and about gear 14. Pulleys 16 are adjustably mounted with ring 4 to facilitate tensioning adjustment of belt 18 against the pulleys and about gear 14. Gear 11 is carried by drive shaft 20 which also mounts a drive pulley 24 which carries a second drive belt 26 whose operation will be later described. Drive shaft 20 is driven by conventional means through drive 22.

Braiding head 7 includes, at its lower end, braiding point A which is of usual construction and which includes a passageway leading to take-up roll 25. The yarns coming from the interlacing points B which are hereinafter described and are arranged about ring 4 come together at braiding point A to form the braided fabric C which is drawn off and by guide rolls, such as roll 25, delivered to a take-up roll D.

The structure described thus far, with the exception of interlacing point B, is substantially conventional and forms no part of the instant invention.

Turning now to FIGS. 1, 5, 6, and 11, the structure incorporating the yarn control apparatus will be described. Shaft 6 mounts a series of vertically spaced plates each of which supports a separate yarn system.

Figure 5:
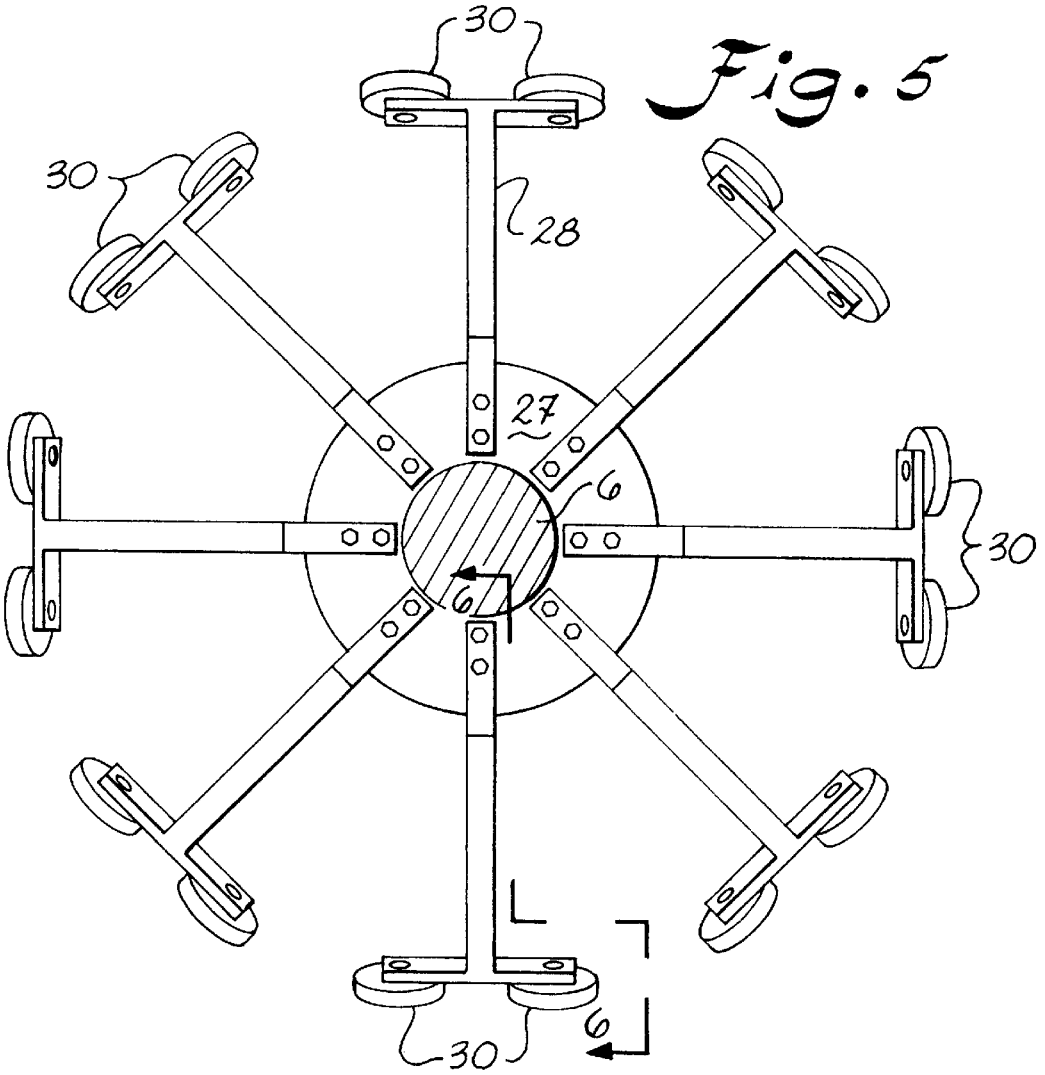
FIG. 5 is a sectional top view of the support system for the interlacing mechanism.

FIGS. 1 and 5 best show upper plate 27 of the structure controlling a stationary yarn E. Plate 27 is secured with shaft 6 and includes a plurality of evenly spaced radially and downwardly extending arms 28. Outer ends of each of arms 28 are formed as a mount which comprises spaced, freely rotatable, parallel wheels 30 which are adopted to mount, in stationary positions, carriages 32 of interlacing system B. Arms 28 are arranged to position support wheels 30 beneath drive wheels 34.

Figure 3:
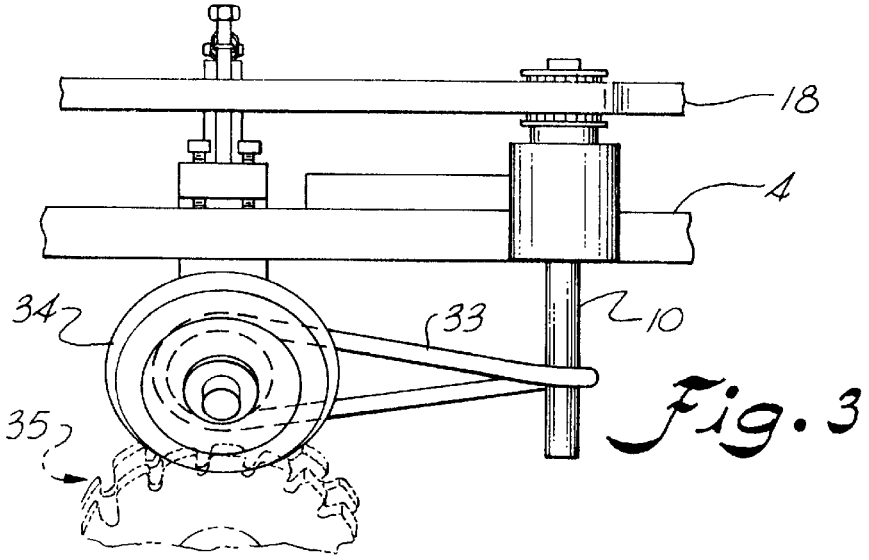
FIG. 3 is an exploded sectional side view of the drive arrangement for the drive wheel.
Figure 4:
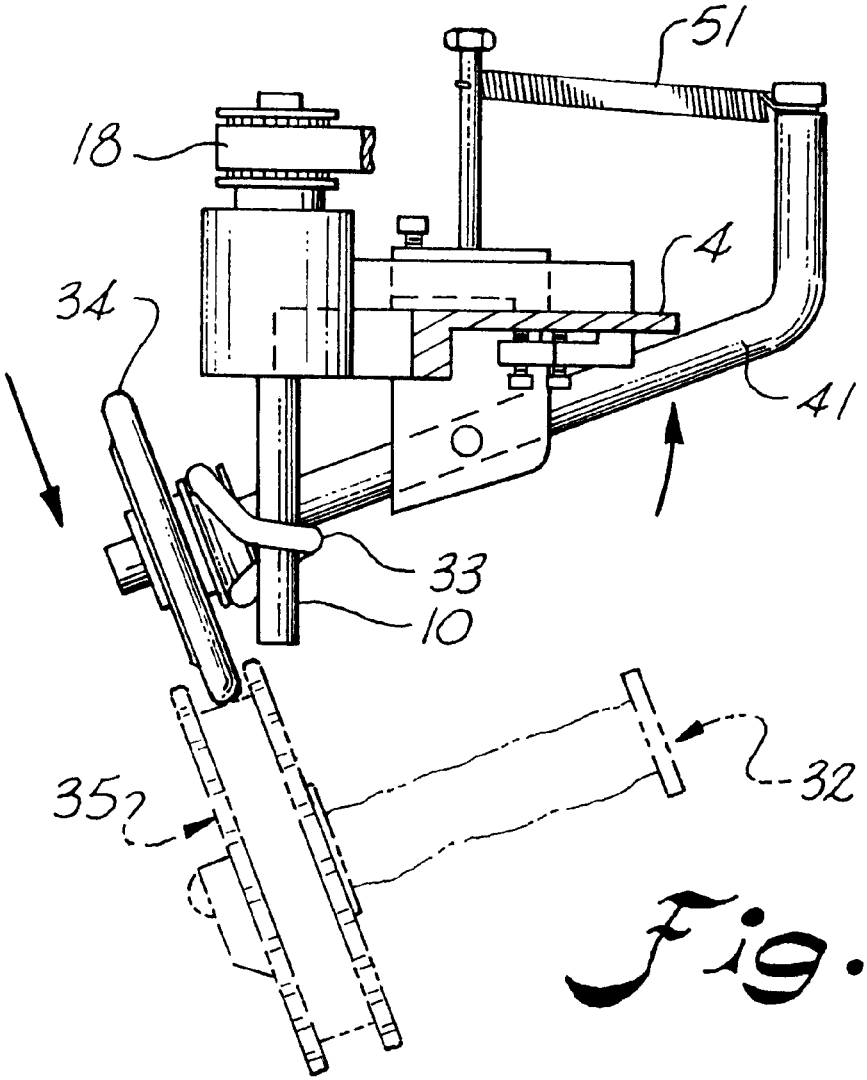
FIG. 4 is an exploded sectional end view of the arrangement of FIG. 3.

Each of drive wheels 34, as shown in FIGS. 3 and 4, are mounted on a shaft 41 which are pivotally mounted with ring 4. Springs 51 urge shafts 41 and drive wheels 34 in a downward direction. Drive belt 33, driven by shaft 10 provides rotation for the drive wheels.

Figure 11:
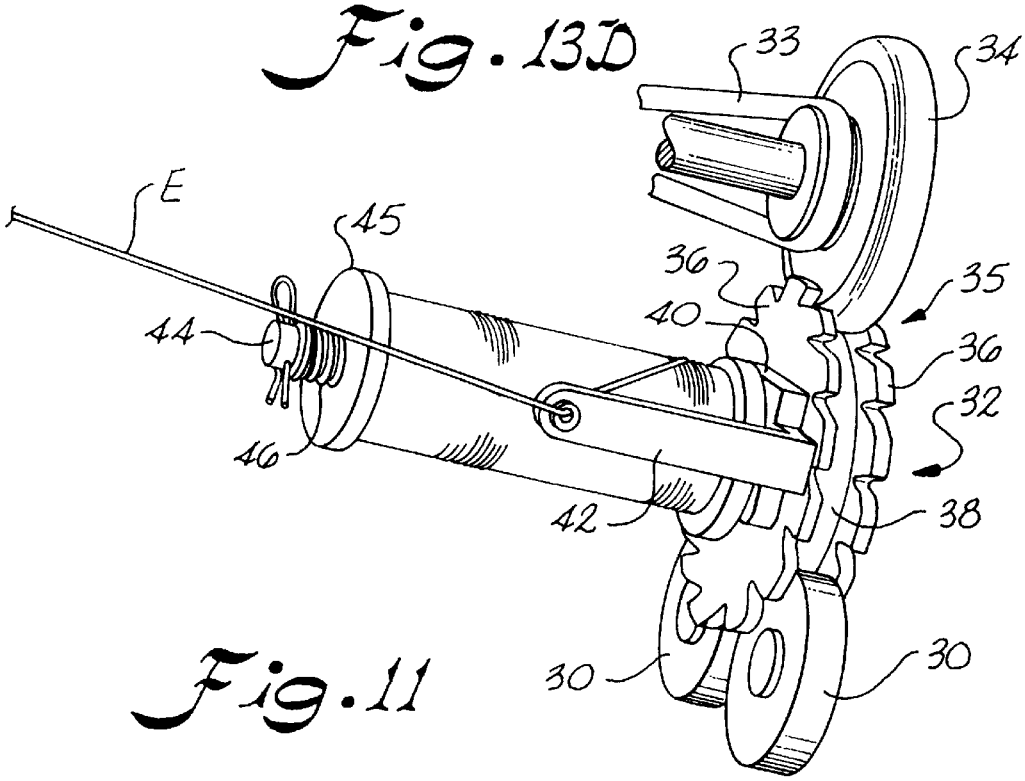
FIG. 11 is a sectional perspective view showing the support structure and the drive structure engaged with the interlacing structure.
Figure 12A:
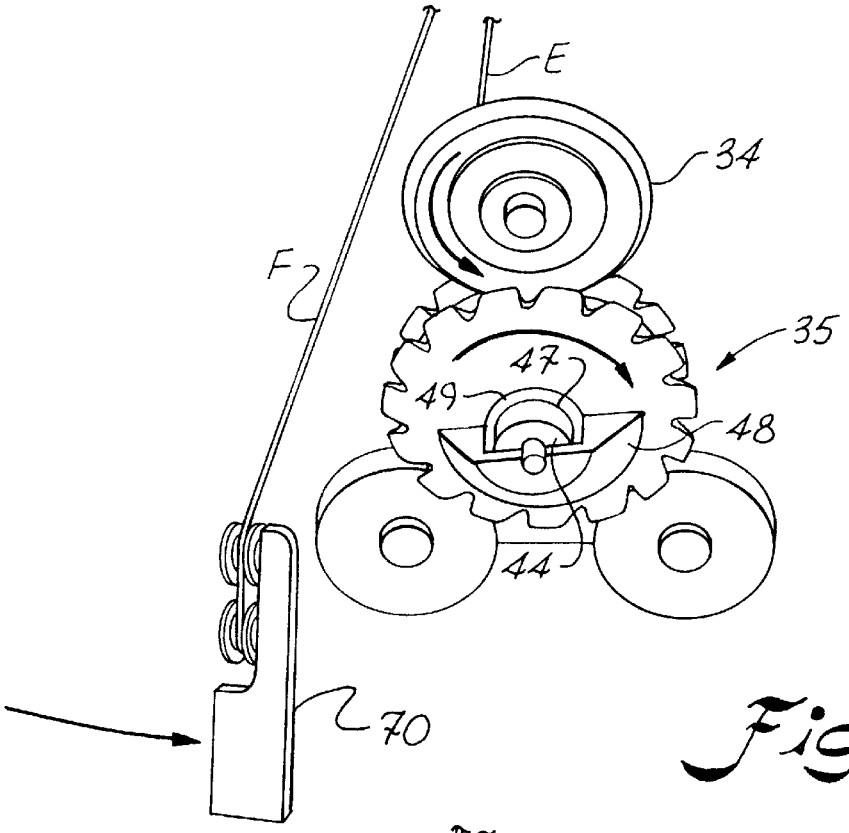
FIGS. 12A, B, and C are schematic views showing the relation of the interlacing wheel and a yarn moving in a first direction.
Figure 12B:
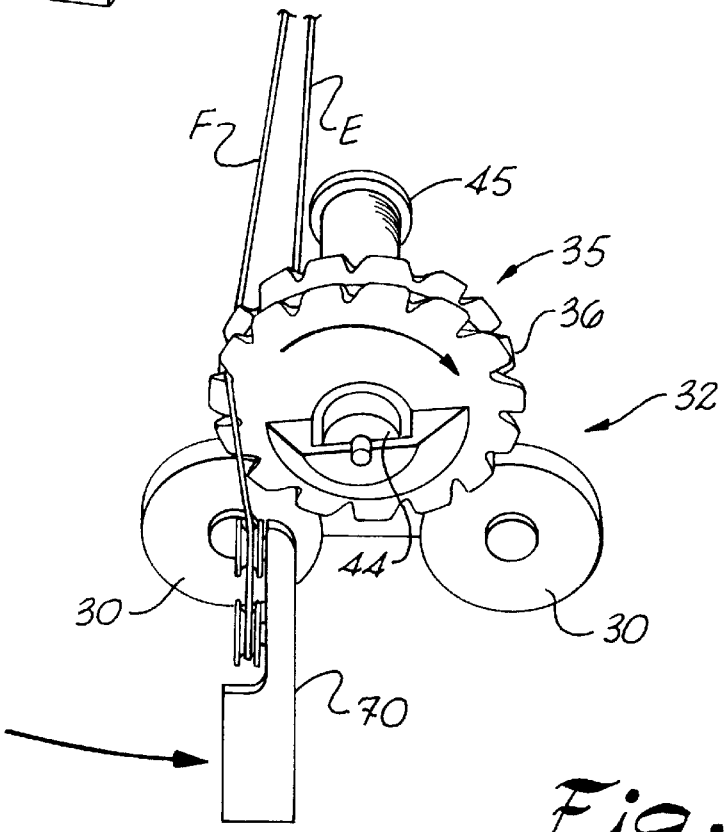
Figure 12C:
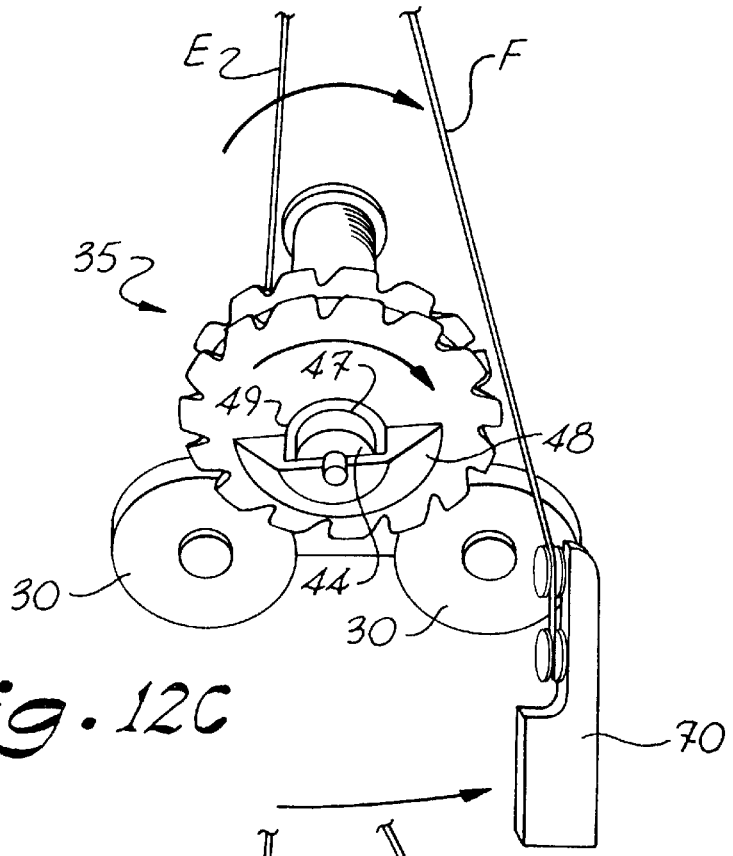
Figure 13A:
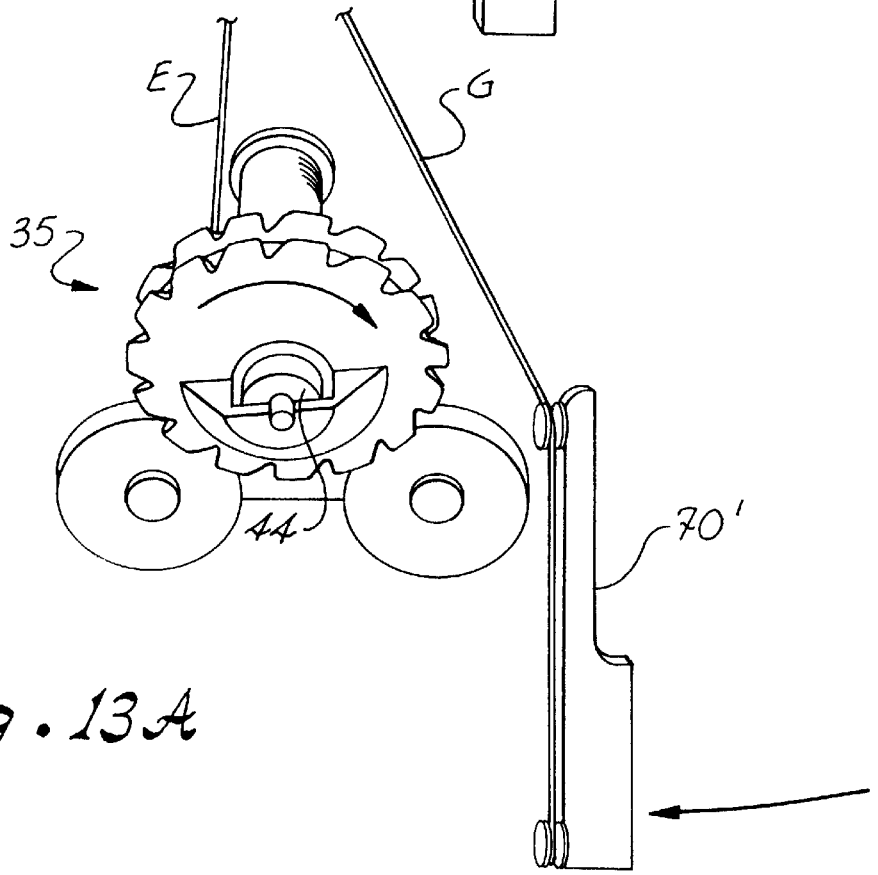
Figure 13B:
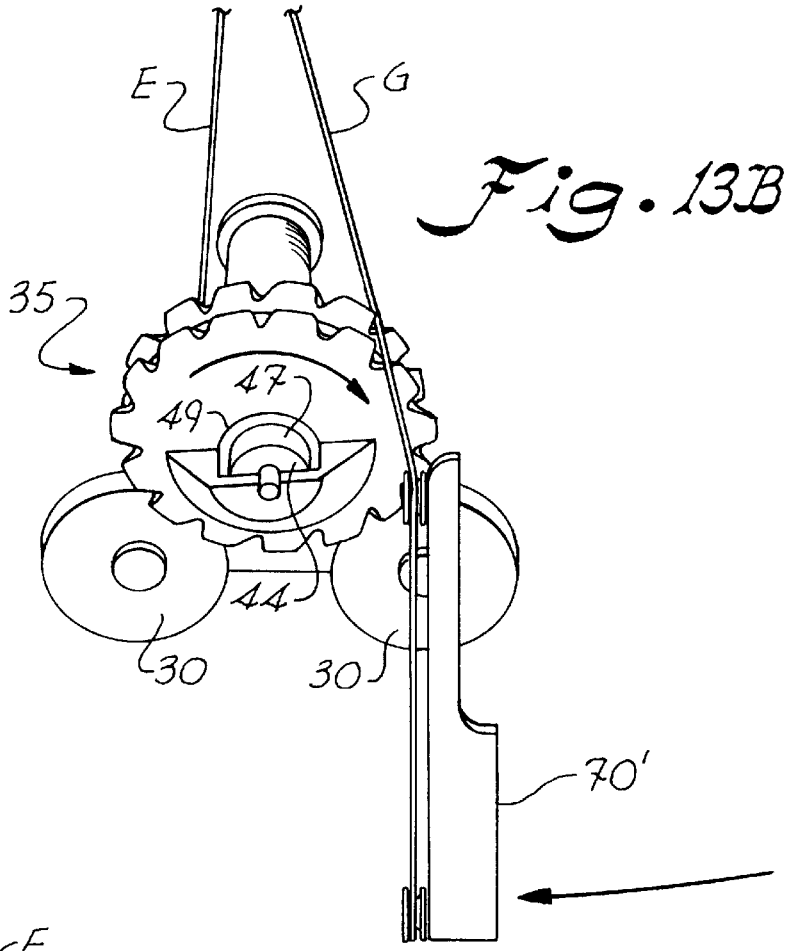
Figure 13C:
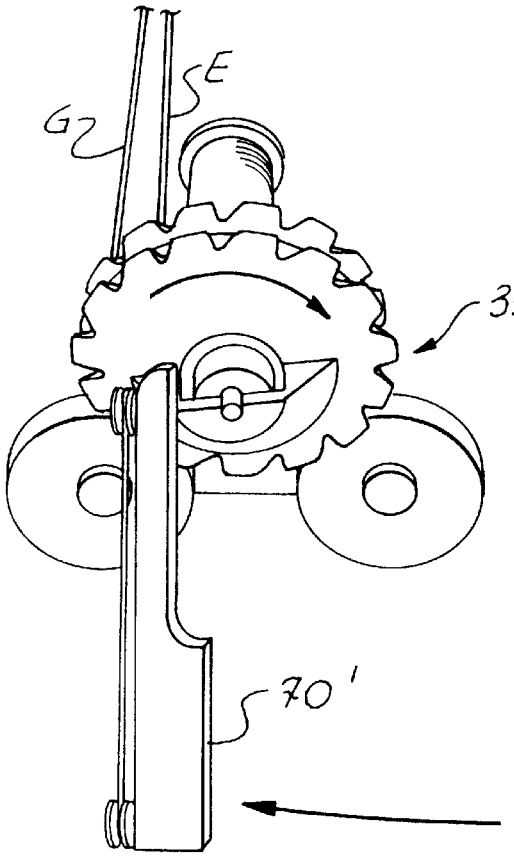

Carriages 32 are supported on each of the mounts by wheels 30 and are maintained in this position by drive wheel 34 as best seen in FIGS. 4 and 11.

Figure 6:
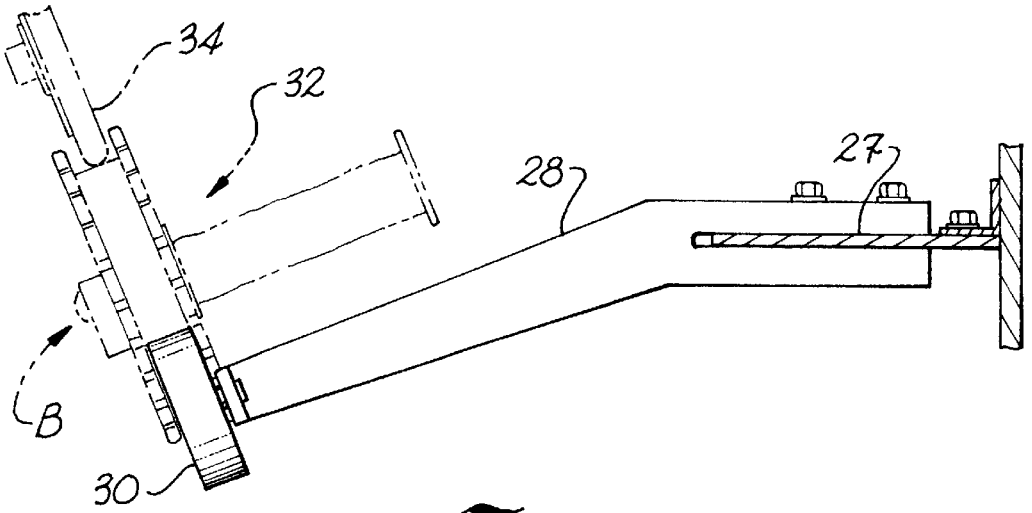
FIG. 6 is an exploded sectional view taken along lines 6—6 of FIG. 5.

Each carriage 32 includes an interlacing mechanism 35 which comprises a disk 38 having an outer circumferential face. A pair of gear plates 36 are secured with opposing faces of disk 38 with their peripheral teeth extending radially outward from the outer circumference of the disk forming a race there between as shown in FIGS. 6 and 11. Alternatively the disk and plates may be formed as a unitary piece.

Figure 13D:
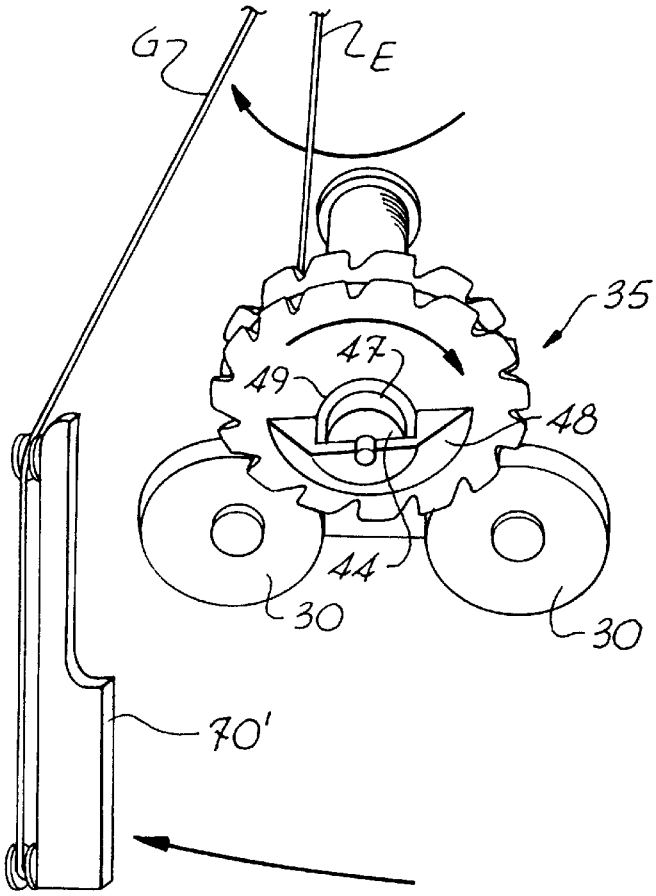
FIGS. 13A, B, C, and D are schematic views showing the relation of the interlacing wheel and a yarn moving in the opposite direction.

Port 49 is formed through disk 38 and gear plates 36 along their axis and receives a bearing 47 as shown in FIGS. 11 and 13D. Stem 44 passes through bearing 47 and carries at one end in a fixed position counterbalance 48. Counterbalance 48 prevents stem 44 from rotating. The inner portion of stem 44 carries brake plate 40 which carries yarn guide 42. A bobbin 45 is mounted for rotation on stem 44. Spring 46 urges bobbin 45 against brake plate 40 providing adjustable braking tension. Other yarn control system may be used to control the yarn let-off such as a ratchet system.

Yarn E is drawn from bobbin 45 to pass through guide 42 and travel along a stationary path located along a third plane to the braiding point A.

Carriage 32 is positioned between wheels 30 with the wheels residing in the race formed by the teeth of interlacing gear plates 36 and the peripheral face of disk 38. Drive wheel 34 is also positioned in the race on the upside of carriage 32. Spring 51 urges drive wheel 34 downwardly with sufficient pressure to maintain carriage 32 in fixed position on wheels 30.

Drive wheel 34 rotates interlacing mechanism 35 of carriage 32 to bring about an interlacing of yarns E, F, and G as will be hereinafter described. As interlacing mechanism 35 rotates about stem 44, counterbalance 48 retains the stem stationary against rotation. Simultaneously yarn E is drawn from bobbin 45 by take-up 25, causing the bobbin to rotate about stem 44. The braking mechanism 46, 40 maintains yarn E under proper tension as it is passed along an intermediate plane to braiding point A.

Figure 7:
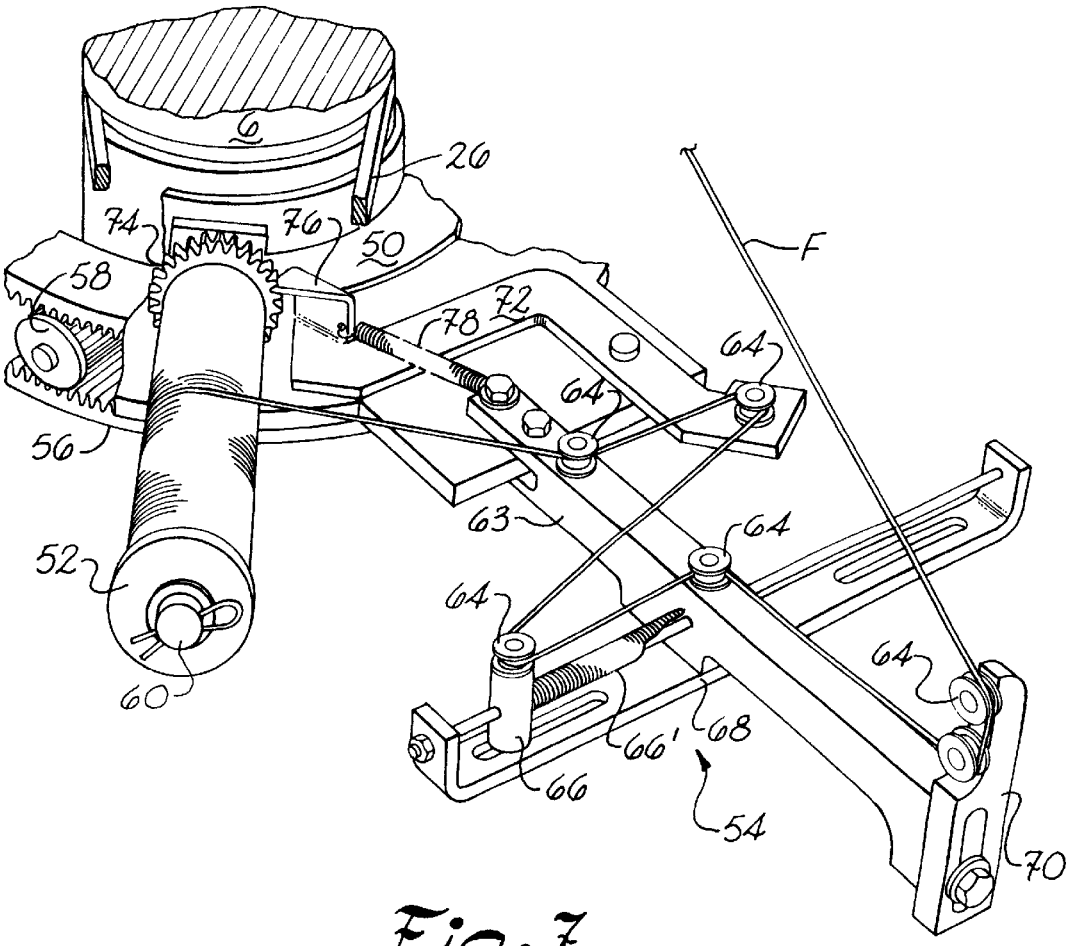
FIG. 7 is a sectional perspective view of mounting structure of yarn rotating about a lower plane.
Figure 8:
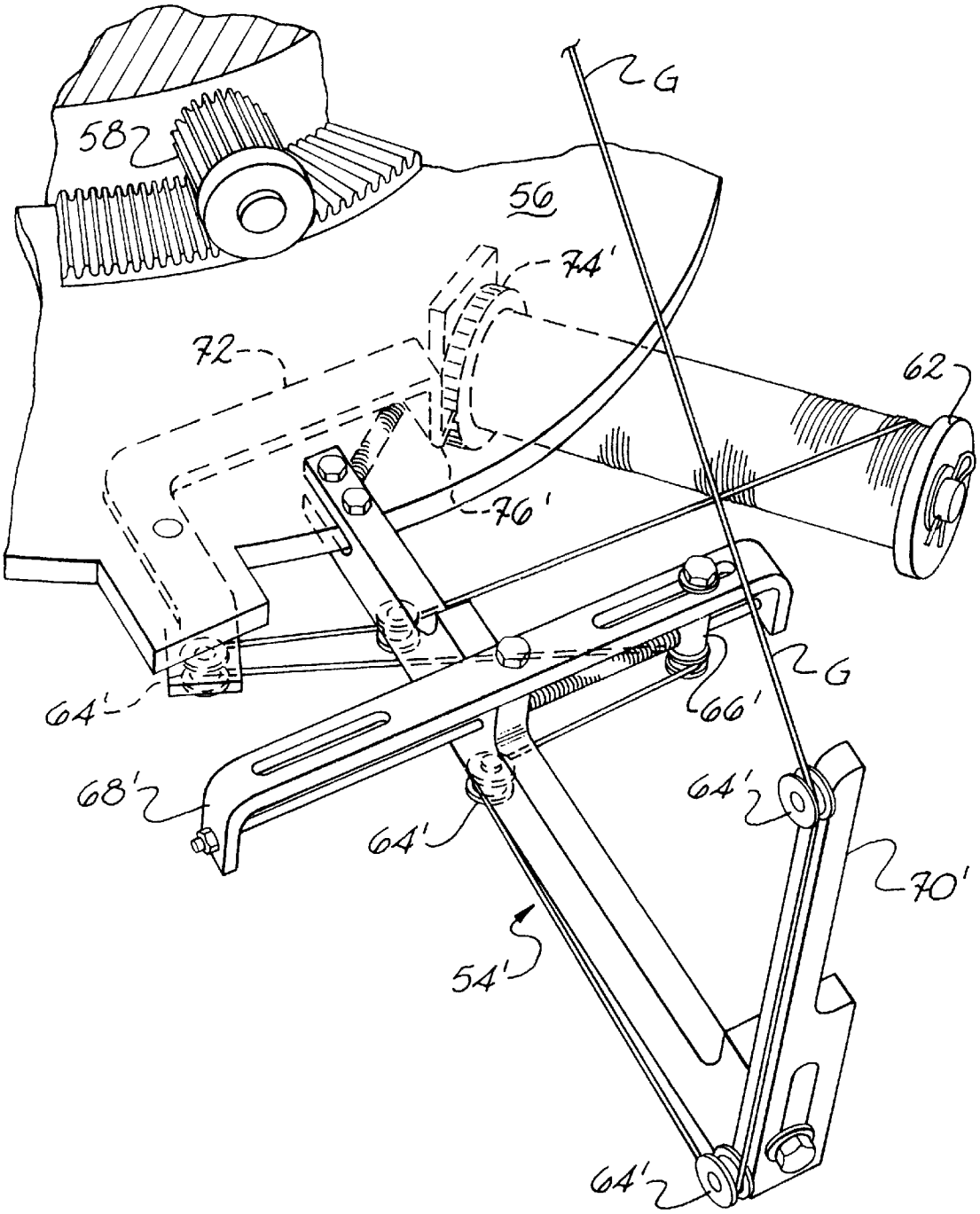
FIG. 8 is a sectional perspective view of mounting structure of a yarn rotating about an upper plane.
Figures 9, 10:
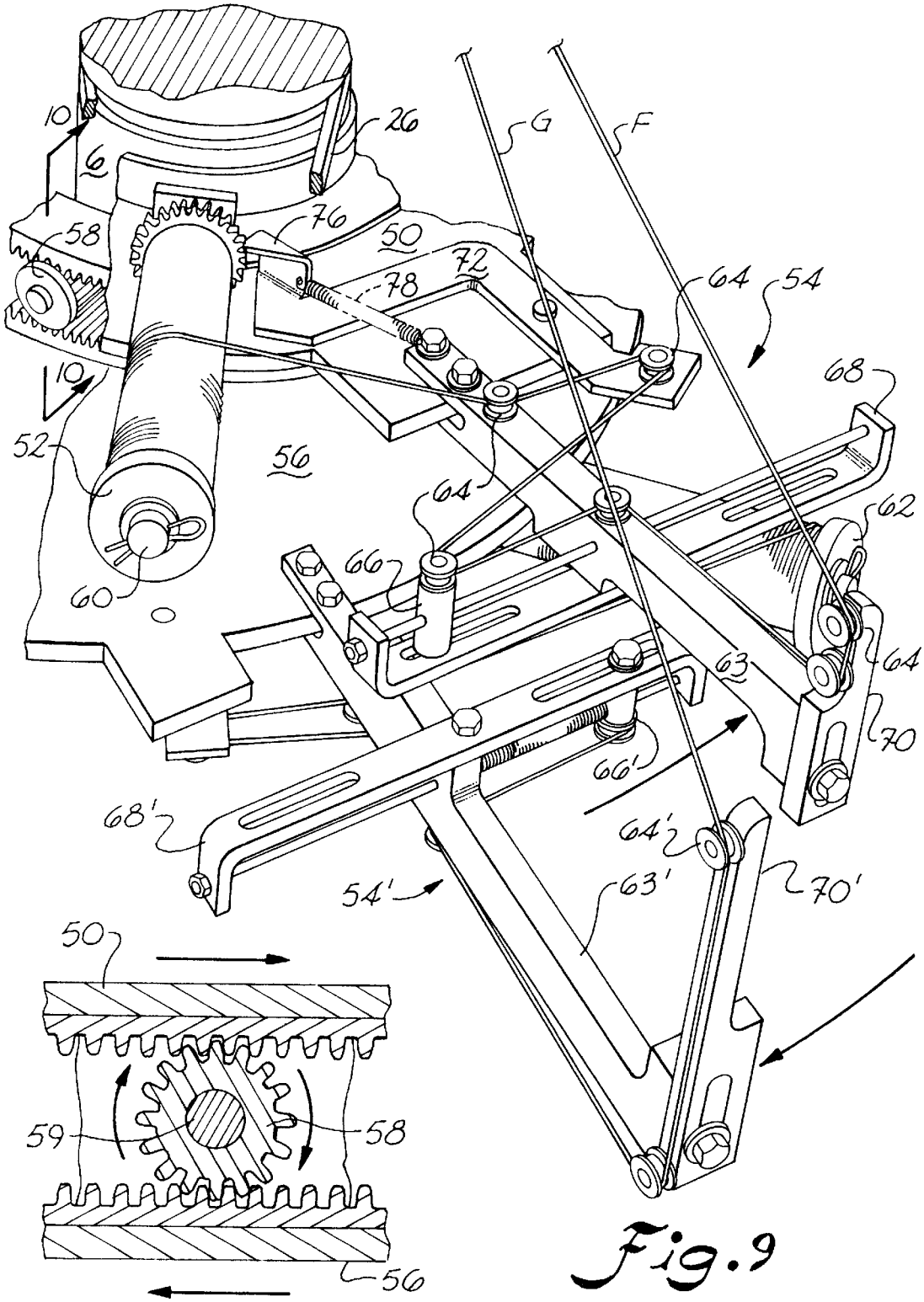
FIG. 9 is a sectional perspective view showing the relationship between the mounting structures of FIGS. 7 and 8.
FIG. 10 is a sectional view of the drive for the mounting structures of FIG. 9.

Mounted on shaft 6 beneath stationary plate 27, as best seen in FIGS. 7 and 9, is a first rotating plate 50 which is driven in a first direction. Plate 50 carries a plurality of first yarns F which are drawn from spools or bobbins 52, passed through control system 54 which includes a plurality of guide members and delivered to braiding point A along a first plane.

Also, mounted on shaft 6 below first plate 50 is a second plate 56 which is rotated with shaft 6 in a direction opposite the direction of rotation of the first plate. Gear 58 carried by pin 59 on shaft 6, drives plate 50.

Bobbins 62 carrying yarn G are mounted on second plate 56. As with first plate 50, yarn G is passed through yarn guides of a control system 54' and passed along a second plane to the braiding point A. It is noted that the plane along which stationary yarn E passes is intermediate of the planes along which yarns F and G pass.

Control systems 54, 54' are substantially identical and therefore only one will be described in detail.

Each bobbin 52, carried by spindle 60 of a bobbin holder mounted on plate 50, is rotated as yarn F is drawn off for delivery to the braiding point. Associated with each bobbin holder is a radially extending guide arm 63 which carries spaced guides 64 and cross slide 68. Slide 68 carries a spring biased sliding guide 66 which is urged by the spring in a direction away from guide am 63. Mounted on the end of guide arm 63 is a vertical extension 70 carrying a pair of yarn guides 64.

Adjacent arm 63 is a pivotally mounted brake arm 72 carrying at one end a yarn guide 64 and a pawl 76 at its opposite end. Pawl 76 is urged against ratchet 74 adjacent an end of spool 52 by spring 78 to normally maintain spool 52 stationary. It is noted other suitable conventional braking mechanisms may be used.

As but seen in FIGS. 7 and 9, yarn F leaving spool 52 is passed about a first of guides 64, outwardly about brake guide 64, then to sliding guide 66, then about second guide 64 and finally to vertical guides 64 carried by vertical extension 70. As yarn F is drawn to braiding head 7, tension on the yarn causes sliding guide 66 to be urged toward arm 63 compressing spring 66'.

Brake arm 72 is also urged to pivoted toward arm 63 against the force of spring 78. As brake arm 72 pivots in oscillation, pawl 76 is intermittently released from contact with ratchet 74 allowing spool 52 to rotate and yarn F to be drawn off. As a consequence of these actions, yarn F is drawn from spool 52 under proper tension and at the proper speed.

It is noted that vertical extension 70 is vertically adjustable relative to arm 63 to selectively position yarn F along the first plane which is located below plane of yarn E and substantially in alignment with the point of contact of drive rollers 30 and disk 38. Vertical extension 70' is likewise vertically adjusted to selectively position yarn G along the second plane which is slightly above the plane of yarn E.

The tension and delivery control system 54' carried by plate 56 is substantially identical with that carried by plate 50. Though not described, the corresponding elements are identified with a corresponding primed number.

As best seen in FIGS. 12A–13D, yarn F is rotating in a first direction, as indicated by the arrow, and on a plane beneath the plane of stationary yarn E. When yarn F moves into engagement with interlacing wheel 35 it is engaged in the teeth of gear plate 36, which is rotating in the direction of the arrow, and carried up and over yarn E and then it is returned to its normal plane of travel. This operation is sequentially shown in FIGS. 12A, B, and C.

Yarn G travels in the direction opposite the direction of yarn F and along a plane above the plane of yarn E. As yarn G moves into contact with the interlacing device 35 it is engaged by the teeth of gear plate 36. The interlacing mechanism 35 moves yarn G in its direction of rotation downwardly below the plane of yarn E and then returns it to its normal plane. This action is clearly shown in FIGS. 13A, B, and C. It is noted that yarns F and G sequentially engage with interlacing device 35, not simultaneously.

By wrapping, in alternating manner, yarns F and G about yarn E braiding is effected. The operation requires a minimum of moving parts, a minimum of yarn control components and operates with less than precise timing. All of the above allow the braiding operation to be conducted at an increased speed with reduced down time.

What is claimed is:

1. A braiding machine having a braiding point comprising:

a stationary frame supporting a central vertical shaft and a braiding point;

a first plate carrying first yarns mounted with said shaft and rotably driven in a first direction;

a second plate carrying second yarns mounted with said shaft and rotably driven in a second direction;

first guides arranged along a first plane carried by said first plate, said first guides each receiving a yarn of said first yarns for delivery along said first plane during passage to said braiding point;

second guides arranged along a second plane and carried by said second plate, said second guides each receiving a yarn of said second yarns for delivery along said second plane during passage to said braiding point;

stationary carriages supported by said frame at stationary points about said vertical shaft, said stationary carriages carrying and delivering third yarns along a third plane to said braiding point, said third plane being intermediate said first and second planes;

an interlacing wheel carried by each of said stationary carriages along said third plane and extending into position to engage with said first and second yarns rotating along said first and second planes; whereby, said interlacing wheels engage and position successively said first and second yarns over and under said stationary yarns at said points to form a braided fabric.

2. The machine of claim 1 including, a stationary third plate carried by said frame about said vertical axis;

a plurality of radially extending arms carried by said third plate; and, a mount secured with each arm for supporting a carriage of said stationary carriages.

3. The machine of claim 2 wherein, said mount comprises a pair of freely rotating support wheels.

4. The machine of claim 3 wherein, a portion of the periphery of said wheels lies along said first plane.

5. The machine of claim 3 including, drive wheels arranged radially about said shaft, a drive wheel of said drive wheels being substantially vertically aligned with each of said pairs of support wheels.

6. The machine of claim 5 wherein, each said interlacing wheel includes a disk having a support race for engaging respective of said support and driving wheels and a pair of gear plates, having teeth, secured with opposing faces of said disk with said teeth aligned and extending radially beyond said support race, inner faces of said teeth engaging with outer faces of said support and driving wheels for supporting said carriage.

7. The machine of claim 6 wherein, each said carriage includes a bobbin mount for mounting a bobbin carrying said stationary yarn, said bobbin mount positioning said bobbin along said third plane.

8. The machine of claim 1 wherein said first and second plates carry a plurality of bobbins carrying said first and second yarns;

a plurality of bobbin supports carried by said first and second plates, each said bobbin carrying said first and second yarns being rotably carried by a bobbin support of said bobbin supports; and, yarn controls operative to determine the rate and the tension of delivery of said first and second yarns from said bobbins to said braiding point.

9. The machine of claim 8 wherein, said bobbin supports rotably carry said bobbins.

10. The machine of claim 9 wherein, each said yarn control includes a pawl and ratchet assembly for controlling the rate and duration of rotation of said bobbins.

11. The machine of claim 10 wherein, each said yarn control includes a pair of movable yarn guides biased in opposed directions and located between a pair of stationary yarn guides; whereby, tension on said yarn during movement between said stationary guides urges said movable yarn guides toward each other.

12. The machine of claim 11 wherein, said movable yarn guides control the rate and duration of rotation of said bobbins.

13. The machine of claim 1 including a plurality of yarn controls carried by said first and second plates, said yarn controls each carrying one of said first and second guides.

14. The machine of claim 13, wherein each said yarn control includes a guide arm having a plurality of movable yarn guides associated with said first and second yarns.

15. The machine of claim 14 including an adjustably mounted vertical extension connected with said guide arms, said extensions carrying said first and second guides.

16. In a braiding machine which operates to deliver a first set of yarns moving about a vertical axis in a first direction along a first plane to a braiding point and a second set of yarns moving about said vertical axis in a second direction along a second plane located above said first plane to said braiding point, the improvement comprising:

a third set of yarns carried by carriage members stationarily arranged about said vertical axis for delivery along a third plane intermediate of said first and second planes to said braiding point;

an interlacing mechanism associated with each yarn of said third set of yarns and including a rotating interlacing member located along said third plane and extending into said first and second planes;

each said member being operative to successively engage and carry said first yarns moving in said first direction out of said first plane, above said third plane and over a third yarn of said third yarns and said second yarns moving in said second direction out of said second plane, below said third plane and beneath a third yarn of said third yarns, causing each of said first and second yarns to successively interlace with each of said third yarns during movement about said vertical axis forming a braided fabric at said braiding point.

17. The machine of claim 16 wherein each said interlacing member includes;

a disk having a circumferential surface of selected width forming a support race;

a pair of gear plates having teeth secured with opposed faces of said disk with said teeth being in alignment and extending radially beyond said race;

a mounting port formed through the axis of said disk and said gear plates for rotably receiving a bobbin mounting stem which extends toward said vertical axis; and, a counterbalance secured with an end of said stem remote said vertical axis for retaining said stem stationary against rotation.

18. The machine of claim 17 including a bobbin carrying a yarn of said third yarns mounted for rotation about said stem;

a yarn guide carried by said interlacing mechanism for receiving said yarn from said bobbin during passage to said braiding point; and, tensioning means carried by said interlacing mechanism controlling tension on said yarn during passage to said braiding point.

19. The machine of claim 17 wherein said counterbalance comprises a half/moon shaped weight secured with said stem.

20. The machine of claim 16 wherein, each said interlacing mechanism includes a mounting device and a driven drive wheel;

said mounting device comprising a pair of rotatable wheels adapted to engage said race of said disk.

21. The machine of claim 20 wherein said drive wheel is located above said rotatable wheels in position to engage said race of said disk; and, a resilient member urging said drive wheel toward said rotatable wheels and against said disk; whereby, rotation of said drive wheel drives said interlacing member in said first direction.

22. The mechanism of claim 21 wherein engagement of said rotatable wheels of said mounting device and said drive wheel with said race of said disk of said interlacing member maintain the position of said interlacing mechanism.

23. A method of braiding including:

providing a first yarn supply and moving yarn of said first yarn supply about a central axis in a first direction along a first plane to a braiding point;

providing a second yarn supply and moving yarn of said second yarn supply about said central axis in a second direction along a second plane above said first plane to said braiding point;

providing a third yarn supply and delivering yarn of said third yarn supply along substantially stationary axis arranged about said central axis and along a third plane intermediate said first and second planes to said braiding point; and, providing apparatus which engages said first yarns as they pass said third yarns and causes said first yarns to deflect from said first plane to pass above said third plane and above each yarn of said third yarns and engages said second yarns as they pass said third yarns and causes said second yarns to deflect from said third plane downwardly to pass beneath each yarn of said third yarns thereby forming a braided fabric.

* * * * *